United States Patent [19]

Becker

[11] Patent Number: 4,735,141

[45] Date of Patent: Apr. 5, 1988

[54] DEVICE FOR SAFEGUARDING A ROTARY PRINTING MAHINE

[75] Inventor: Willi Becker, Bammental, Fed. Rep. of Germany

[73] Assignee: Heidelberger Druckmaschinen AG, Heidelberg, Fed. Rep. of Germany

[21] Appl. No.: 44,794

[22] Filed: Apr. 30, 1987

[30] Foreign Application Priority Data

Apr. 30, 1986 [DE] Fed. Rep. of Germany ..... 3614734

[51] Int. Cl.[4] ..... B41F 33/04; B41F 13/14

[52] U.S. Cl. ..... 101/232; 101/246; 101/410; 226/27; 271/82; 271/277

[58] Field of Search ..... 101/228, 216, 246, 409, 101/410, 407 A, 420, 232; 271/82, 251, 277, 198, 205; 226/24, 27, 32, 40, 41, 134, 158, 162

[56] References Cited

U.S. PATENT DOCUMENTS

| | | | |
|---|---|---|---|
| 1,916,564 | 7/1933 | Elliott | 101/216 |
| 3,229,629 | 1/1966 | Conchon | 101/216 |
| 4,014,261 | 3/1977 | Becker | 101/183 |
| 4,147,105 | 4/1979 | Becker | 101/231 |
| 4,454,812 | 6/1984 | Johne | 101/216 |
| 4,669,380 | 6/1987 | Seib | 101/216 |

FOREIGN PATENT DOCUMENTS

| | | | |
|---|---|---|---|
| 1279031 | 10/1968 | Fed. Rep. of Germany | 101/216 |
| 2620392 | 4/1978 | Fed. Rep. of Germany . | |
| 2632243 | 8/1979 | Fed. Rep. of Germany . | |
| 3315445 | 10/1984 | Fed. Rep. of Germany | 101/216 |

*Primary Examiner*—Clyde I. Coughenour

*Attorney, Agent, or Firm*—Herbert L. Lerner; Laurence A. Greenberg

[57] ABSTRACT

A device for safeguarding a rotary printing machine for printing sheets in a first form and perfector printing operation having a storage and a turning drum, first adjusting elements for adjusting a trailing drum body of the storage drum to different format sizes, second adjusting elements for adjusting the turning drum, and grippers and mechanical and electrical means for safeguarding the printing machine during a system-determined function setting includes a first coupling wheel assigned to the trailing drum body of the storage drum, a second coupling wheel mounted on a shaft journal of the turning drum, both of the coupling wheels being linked free of slippage via drive means in such a way that the second coupling wheel and the turning drum run in synchronism, the second coupling wheel being braced axially via trip cams on a disk secured to the shaft journal so that, in a case of rotation between the second coupling wheel and the turning drum due to a fault, a switching pulse is issued which releases a signal.

4 Claims, 6 Drawing Sheets

DEVICE FOR SAFEGUARDING A ROTARY PRINTING MAHINE

The invention relates to a device for safeguarding a rotary printing machine for printing sheets in a first form and a subsequent printing such as a perfector printing operation having a storage and a turning drum, first adjusting elements for adjusting a trailing drum body of the storage drum to different format sizes, second adjusting elements for adjusting the turning drum, and grippers and mechanical and electrical means for safeguarding the printing machine during a system-determined function setting.

In the case of such machines, the sheet to be printed by first form and perfector printing is transferred during the sheet travel by a first transfer drum to a storage drum having two sheet carrying surfaces on its circumference. When the machine is set for first form and perfector printing, the leading edge of the sheet on the storage drum is moved by a row of grippers arranged at this point past the tangential point between the storage drum and a succeeding turning drum. At the same time, the trailing edge of the sheet is held on the storage drum by suction elements. The instant the trailing edge of the sheet held by the suction elements reaches the aforementioned tangential point, it is seized by a gripper mechanism of the turning drum. At the same time, the leading edge of the sheet is released by the grippers on the storage drum, and the sheet is transferred, trailing edge first, by the turning drum to the next impression cylinder. So-called tongs grippers, for example, serve as the gripper mechanism of the turning drum.

Such sheet printing machines are provided to print different sheet formats. The storage drum is therefore formed of a cylindrical housing with two drum bodies which can turn within each other in a comb-like manner so that the front grippers can hold a sheet of any arbitrary length and the succeeding drum body with the suction rail mounted on it can be adjusted to the relevant format (note German Patent No. DE-PS 26 32 243). As one of the drum bodies, namely the trailing drum body of the storage drum is displaced, the turning drum is also displaced simultaneously so that the grippers at this point exactly receive the trailing end of the sheet from the turning drum in order to carry out the second impression in the following printing unit.

In the case of this format adjustment, therefore, a setting or adjustment of various individual elements is necessary, requiring a high degree of skill from the machine operator. For example, if only one small operation error is made, there is the risk of damage to the machine.

The removal or correction is extremely time consuming and costly. For example, if the clamping between the two drum bodies of the storage drum is not set exactly, there is a danger that the trailing drum body will be offset slightly during machine operation and collide with the grippers of the turning drum. This can result in considerable damage to the individual units, making necessary a lengthy machine downtime.

A device for safeguarding a rotary printing machine is known from German Patent No. (DE-PS) 26 20 392. The individual adjustment procedures and the system-dependent function setting when converting to perfector printing are safeguarded. The system ensures that the machine operator will carry out all the necessary individual settings. This known construction, however, does not ensure that, for example, each individual clamping screw is tightened exactly and it also provides no safeguard against settings being changed during machine operation.

Based on this state of the art, it is an object of this invention to avoid damage to the machine during first form and perfector printing as a result of faulty or incorrect settings and undesired changes in settings, respectively, while at the same time it provides a safeguard for the machine which is effective both when the machine is stationary and during operation and also ensures that both the trailing drum body of the storage drum as well as the turning drum are adjusted simultaneously during the format setting procedure.

With the foregoing and other objects in view, there is provided, in accordance with the invention, a device for safeguarding a rotary printing machine for printing sheets in a first form in a perfector printing operation having a storage and a turning drum, first adjusting elements for adjusting a trailing drum body of the storage drum to different format sizes, second adjusting elements for adjusting the turning drum, and grippers and mechanical and electrical means for safeguarding the printing machine during a system-determined function setting, comprising a first coupling wheel assigned to the trailing drum body of the storage drum, a second coupling wheel mounted on a shaft journal of the turning drum, both of the coupling wheels being linked free of slippage via drive means in such a way that the second coupling wheel and the turning drum run in synchronism, the second coupling wheel being braced axially via trip cams on a disk secured to the shaft journal so that, in a case of rotation between the second coupling wheel and the turning drum due to a fault, a switching pulse is issued which releases a signal.

The coupling wheels on the trailing drum body of the storage drum and on the shaft end of the turning drum and its mechanical coupling ensure during format setting that both assemblies are correctly adjusted. The switching pulse which is given in the case of incorrect adjustment prevents the machine from being started if it is in a stationary condition and stops the machine if it is running. The given signal draws the operator's attention to the fault so that damage is avoided by relatively simple means.

The signal which is triggered can be a visual or acoustic signal as is standard practice in printing machine construction.

In accordance with another feature of the invention, the first coupling wheel assigned to the trailing drum body of the storage drum is in driving engagement with a spur gear mounted on a shaft rotatably journalled in the machine side frame and, mounted on the opposite end of the shaft is a toothed belt pulley coupled by a toothed belt with the second coupling wheel mounted on the shaft journal of the turning drum and constructed as a toothed belt pulley.

In accordance with an additional feature of the invention, mounted on the opposite end of the shaft journalled in the machine side frame is a spur gear coupled via idler gears with the coupling wheel constructed as a spur gear of the turning drum.

In accordance with a concomitant feature of the invention, the second coupling wheel on the shaft journal of the turning drum is mounted so that it is rotatable and axially shiftable, and is braced under the force of springs against the trip cams so that in a case wherein rotation occurs resulting from a fault, the trip cams transmit an axial movement to the second coupling wheel for operating a switch via a roller and a shift lever mounted on the side frame.

Other features which are considered as characteristic for the invention are set forth in the appended claims.

Although the invention is illustrated and described herein as embodied in a device for safeguarding a rotary printing machine, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
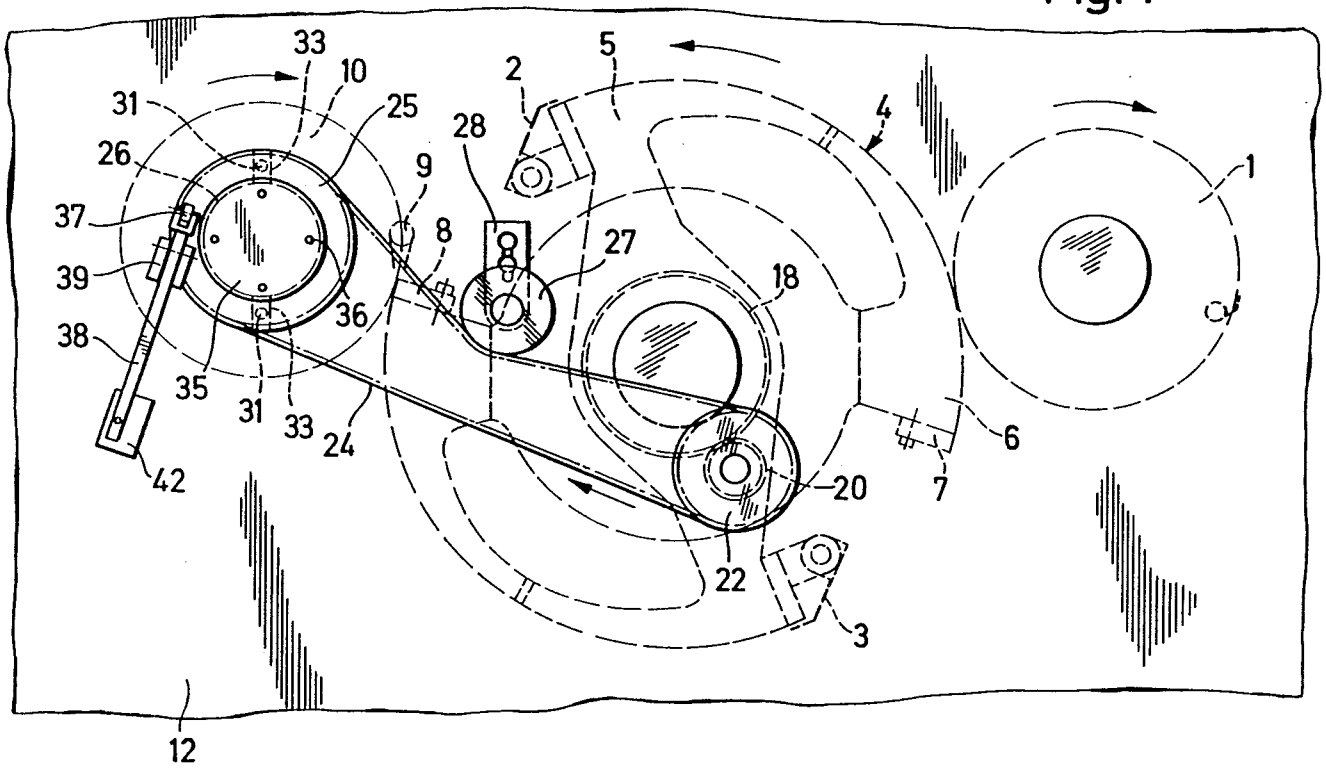
FIG. 1 is an end view of respective storage and turning drums with a safeguarding device according to the invention.

Referring now to the drawing and first, particularly, to FIG. 1 thereof, there are shown drums 1, 4, 10 arranged between two printing units of a rotary printing machine, a transfer drum 1 receiving a printed sheet from a printing unit and transferring it to a row of grippers 2, 3 of a storage drum 4. The storage drum 4 is formed of a fore-running or leading drum body 5, on which the rows of grippers 2 and 3 are mounted and an after-running or trailing drum body 6, on which suction rails 7 and 8 for the trailing end of the sheet are mounted. The two drum bodies 5 and 6 are of comb-like construction and can be swivelled with respect to each other in such a way that the distance between the rows of grippers 2 and 3 and the suction rails 7 and 8 can be varied in accordance with the sheet size or format to be processed.

When the machine is set for first form and perfector printing, one end of the printed sheet is taken over by tongs grippers 9 of the turning drum 10 and transferred to the next printing unit. In this way, the end of the sheet held by the suction rails 7 and 8 is conveyed farther with a high degree of accuracy by the tong grippers 9 in order to facilitate further processing precisely in register. The instant the tong grippers 9 have grasped the end of the sheet, the rows of grippers 2 and 3, respectively, open and release the sheet so that, as the turning drum continues to rotate, the sheet is pulled from the storage drum 4. For this purpose, the tong grippers 9 rotate approximately 180° in a direction opposite to the direction of rotation of the turning drum 10.

Figure 2:
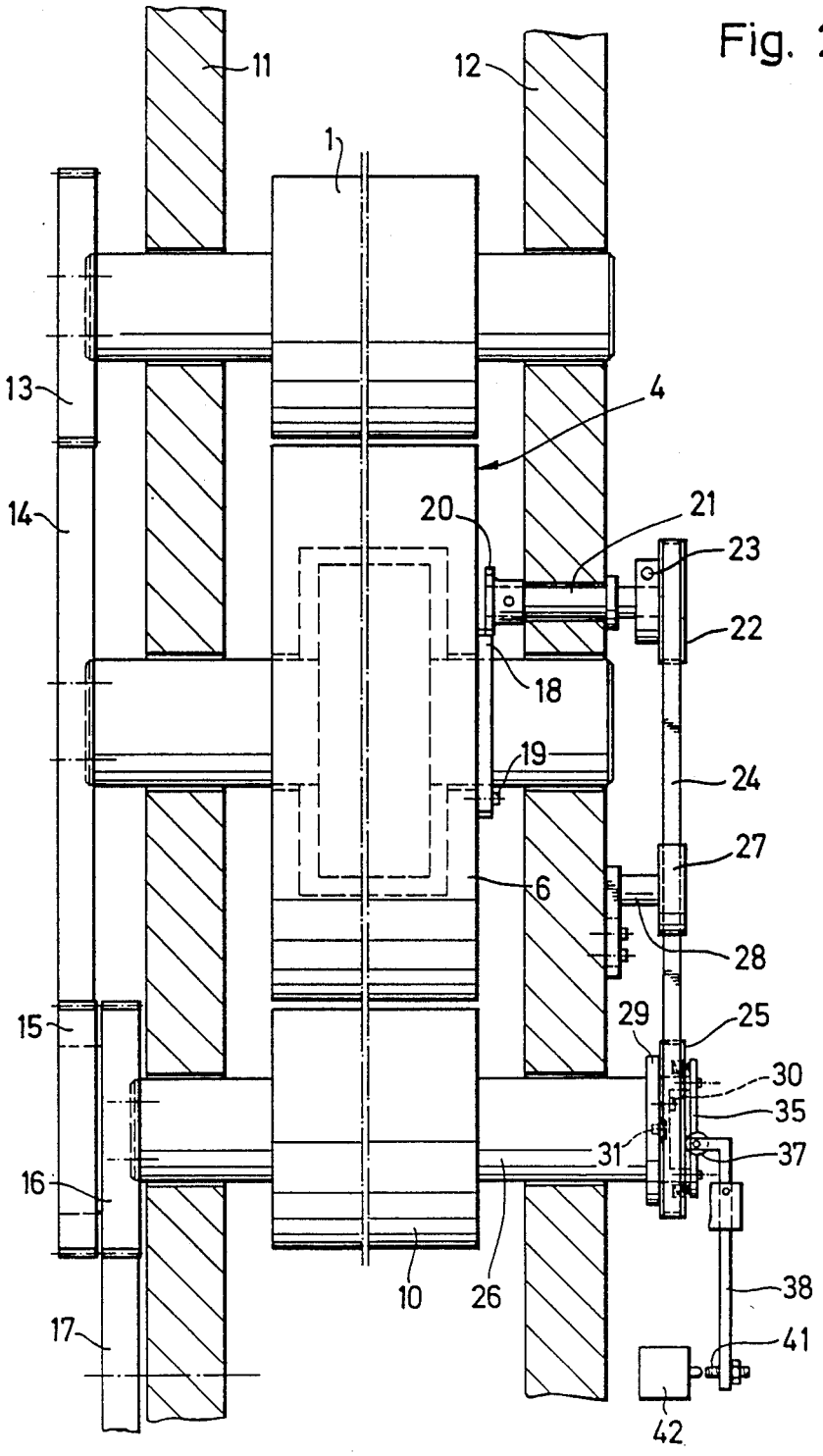
FIG. 2 is a longitudinal sectional view of FIG. 1 showing the safeguarding device.

As can be seen in FIG. 2, the transfer drum 1, the storage drum 4 and the turning drum 10 are mounted in the machine side frames 11 and 12 and are driven by spur gears 13 to 17.

To safeguard the format setting during first form and perfector printing, a coupling gear 18 is coupled, for example, by means of screws 19 or entrainers on the trailing drum body 6 of the storage drum 4. A spur gear 20 fitted on a shaft 21 which is journalled in the machine side frame 12 so that it can rotate, engages in the coupling gear 18. On the opposite end of the shaft 21, in the embodiment of FIG. 2, a belt pulley 22 is fixed in position by means of a clamping screw 23, thereby serving as a setting or adjustment for a home or initial position. A toothed belt 24 couples the belt pulley 22 with a coupling wheel 25 which is also constructed as a toothed belt pulley and is arranged on the shaft journal 26 of the turning drum 10. The toothed belt 24 can be tightened by a tensioning roller 27 which is mounted on a bracket 28 on the machine side frame 12 so that it is adjustable.

Figure 3:
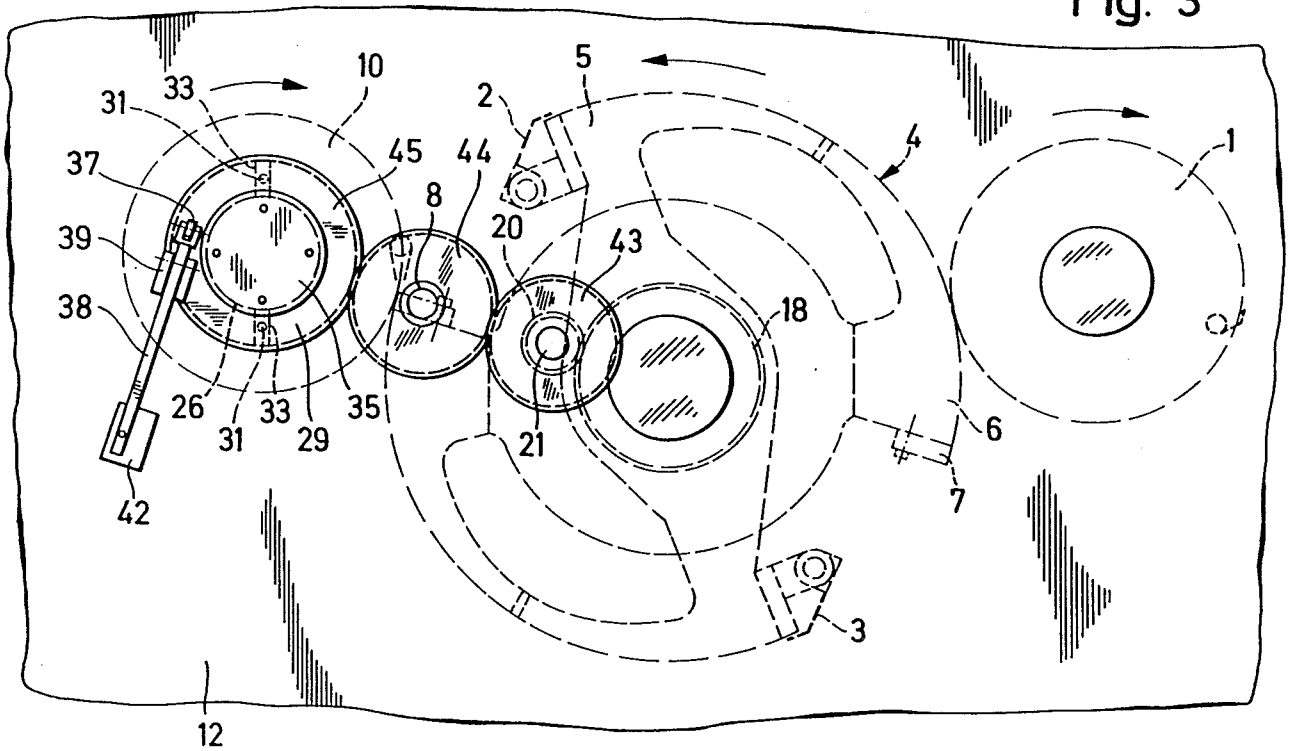
FIG. 3 is a view like that of FIG. 1 with other drive means.
Figure 4:
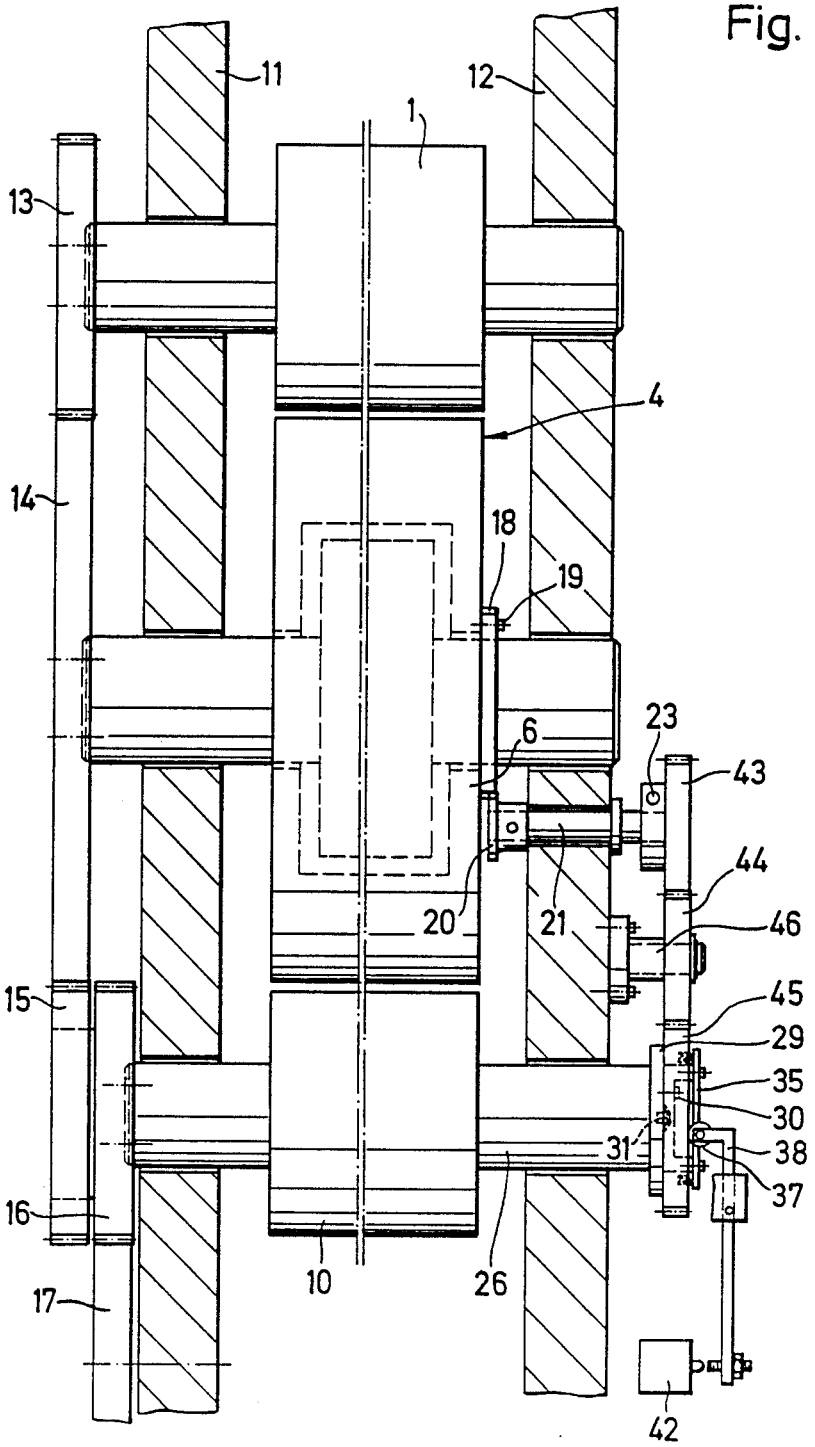
FIG. 4 is a longitudinal sectional view of FIG. 3 showing the safeguarding device.
Figure 5:
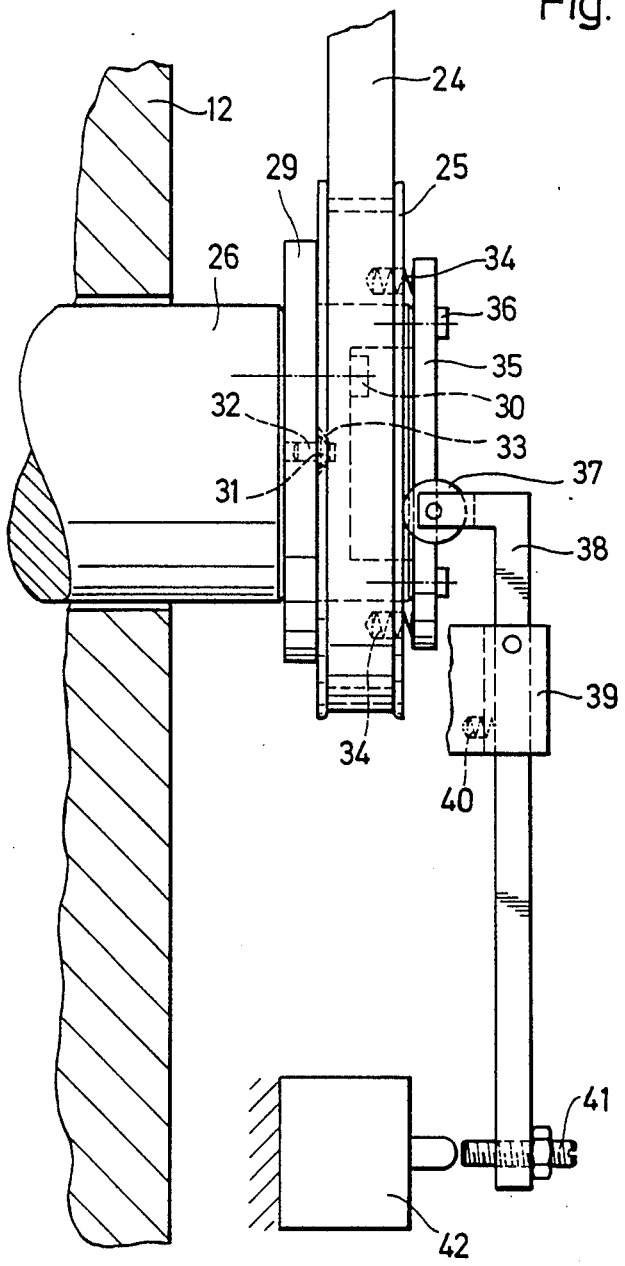
FIG. 5 is a top plan view of the safeguarding device in operating position.

A ring 29 is secured with screws 30 on the journal 26 of the turning drum 10 (FIGS. 2–6). The coupling wheel 25 is mounted so that it is rotatable and shiftable axially with respect to the ring 29. To fix the position of the coupling wheel 25, trip cams 31 are provided which are secured in the ring 29 by pins 32 (FIG. 5). This arrangement involves two trip cams 31 which are arranged offset by 180° and which engage with their bevelled cams in corresponding recesses of the coupling wheel 25. The bevelled sections 33 are advantageously formed so that the coupling gear 25 rests on the ring 29 in operating position (FIG. 5). To ensure that the coupling wheel 25 firmly rests on the ring 29, compression springs 34 are provided which are supported on a cover plate 35 which is also secured to the ring 29 by means of screws 36. The compression springs 34 press the coupling wheel 25 against the ring 29.

Figure 6:
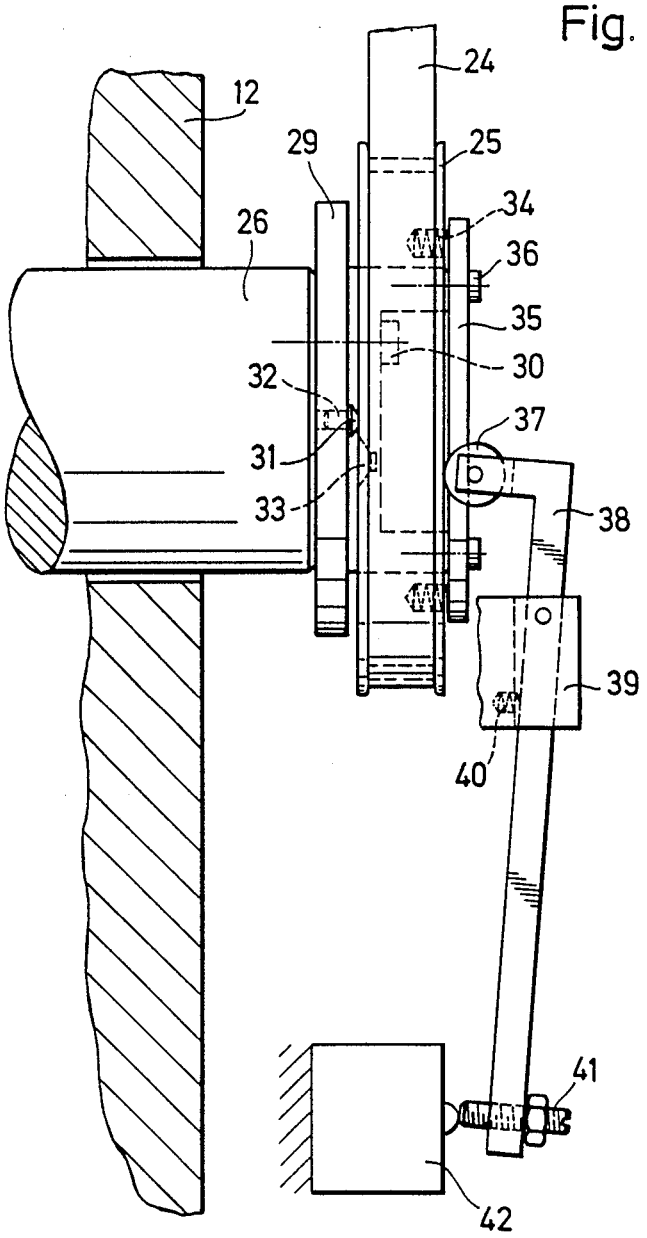
FIG. 6 is a top plan view of the safeguarding device in switching position.

If the coupling wheel 25 is turned with respect to the ring 29 and therefore with respect to the trip cams 31, then the trip cams 31 slide over the chambers 33 and out of the recesses of the coupling wheel 25 so that the latter is shifted axially against the force of the compression springs 34 (FIG. 6). A roller 37 secured to a shift lever 38 rests on the coupling wheel 25. The shift lever 38 in turn is mounted in a bearing 39 so that it can pivot on the machine side frame 12 and is subject to the force of a compression spring 40 which ensures reliable contact of the roller 37 on the coupling wheel 25. The opposite end of the shift lever 38, via a setting screw 41, actuates a switch 42 which, in this position, prevents the machine from being started up if it is stationary and switches off the machine if it is running. This ensures that, in the case of unwanted turning of the two drum bodies 6 and 10 with respect to each other, damage to the grippers 9 or the suction rails 7 and 8 is prevented.

The embodiment of FIGS. 3 and 4 differs from the previously described embodiment of FIGS. 1 and 2 in that it has different drive means between the coupling wheels 18 and 25. In the embodiment of FIGS. 3 and 4, there is mounted on the end of the shaft 21 opposite the spur gear 20, a spur gear 43 which interacts with a coupling gear 45, also a spur gear, in conjunction with one or more idler gears 44. In this case, the idler gear 44 is mounted on a pivot pin 46 on the machine side frame. The number of intermediate gears 44 depends upon the distance which must be bridged, the direction of rotation of the coupling gear 45 agreeing with that of the turning drum 10. Also in this drive alternative of the illustrared drive elements, the coupling gear 45 is mounted so that it is shiftable axially and triggers a switching pulse via the trip cams 31.

The foregoing is a description corresponding in substance to German Application No. P 36 14 734.6, dated Apr. 30, 1986, the International priority of which is being claimed for the instant application, and which is hereby made part of this application. Any material discrepancies between the foregoing specification and the aforementioned corresponding German application are to be resolved in favor of the latter.

I claim:

1. A device for safeguarding a rotary printing machine for making plural prints of printing sheets in a printing operation, the machine including a storage and a turning drum with sheet-holding means, first elements for adjusting the spacing between leading and trailing drum body holding means of the storage drum for use with different size sheets, mechanical and/or electrical means associated with said turning drum, second elements for adjusting the turning drum holding means and mechanical and/or electrical means to accomodate adjustment with the first elements, comprising; first wheel means securely coupled to the trailing drum body of the storage drum, second wheel means coupled to the turning drum and capable of relative movement therewith, both of said wheels linked together by slippage-free drive means such that said first and second wheel means and storage drum turn in synchronism, surface means secure with the turning drum, said second wheel means being coupled with said surface means by trip cam means, said surface means and second wheel means being held together such that a fault-causing relative rotation between the storage and turning drums also causes movement between said surface and second wheel means to activate said electrical and/or mechanical means and cause a switching pulse to issue.

2. Device according to claim 1, wherein said first wheel means coupled to the storage drum is a toothed belt pulley in driving engagement with a spur gear mounted on a shaft rotatbly journalled in the machine side frame, said second wheel means coupled to the turning drum is a toothed belt pulley and, a toothed belt means coupling said first and second wheel means.

3. Device according to claim 1, wherein said first and second wheel means are spur gears coupled together by idler gear means.

4. Device according to claim 1, wherein said second wheel means coupled to the turning drum is rotatable and axially shiftable, and is braced under the force of springs against said trip cam means, so that when a fault occurs said trip cam means transmits an axial movement to said second wheel means for operating a switch via a roller and shift lever mounted on the side frame.

* * * * *